US005904114A

United States Patent [19]

Wright

[11] Patent Number: 5,904,114

[45] Date of Patent: May 18, 1999

[54] PERSONAL WATERCRAFT CANOPY

[76] Inventor: Robert L. Wright, P.O. Box 767, Fernandia Beach, Fla. 32035

[21] Appl. No.: 08/996,837

[22] Filed: Dec. 23, 1997

[51] Int. Cl.[6] ..... B63B 17/00

[52] U.S. Cl. ..... 114/361; 114/55.005

[58] Field of Search ..... 114/343, 364, 114/361, 270, 272, 273, 55.5

[56] References Cited

U.S. PATENT DOCUMENTS

| | | | |
|---|---|---|---|
| 3,604,440 | 9/1971 | Wilson | 114/361 |
| 4,667,619 | 5/1987 | Nishida | 114/270 |
| 4,736,700 | 4/1988 | Ishimatsu et al. | 114/273 |
| 4,824,409 | 4/1989 | Kobayashi | 114/270 |
| 5,361,717 | 11/1994 | Kobayashi | 114/361 |
| 5,697,320 | 12/1997 | Murray | 114/361 |

*Primary Examiner*—Ed L. Swinehart
*Attorney, Agent, or Firm*—Murray Leonard

[57] ABSTRACT

A collapsible personal watercraft canopy which when extended, provides protection from the weather and support for the watercraft occupants, and also provides lift when the watercraft is in motion, reducing water resistance and which when closed is folded forward and stored on the forward upper hull surface of the watercraft, thus providing protection from sea spray while remaining attractive.

8 Claims, 4 Drawing Sheets

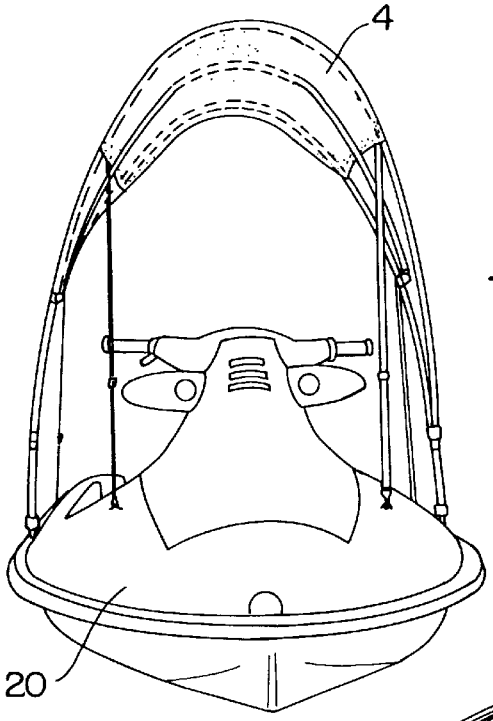
FIG. 1
FIG. 2
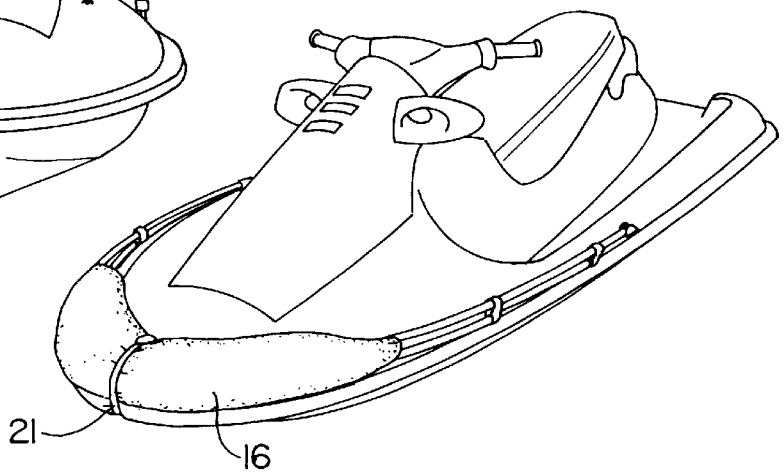
FIG. 3
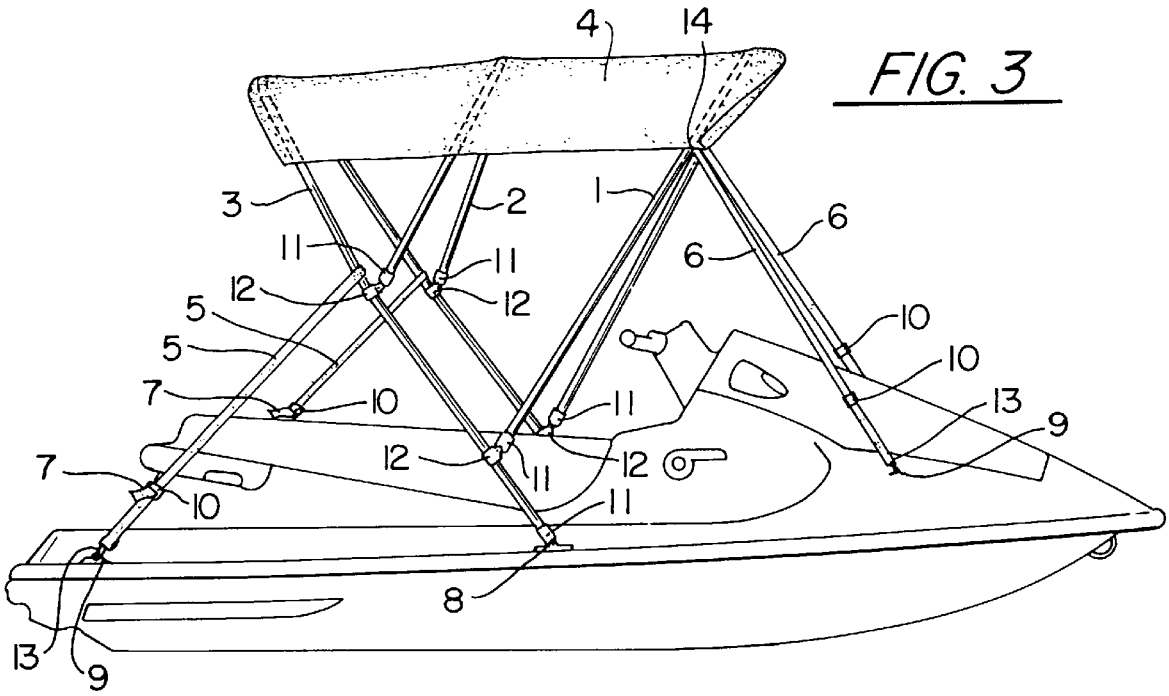

PERSONAL WATERCRAFT CANOPY

TECHNICAL FIELD

This invention relates to a convertible top on a jet propelled watercraft, for shading out the sun or protecting the occupants from the effects of weather. The jet propelled watercraft is often referred to in the industry as a "Personal Watercraft". The term personal watercraft will hereinafter be used when referring to jet propelled watercraft of those typified for the present invention. This invention relates particularly to an installed convertible top canopy which is adapted to collapse into a storage position within the rub rail molding around the bow, and on the top hood area of the forward hull section, of the personal watercraft. The collapsed shape of the canopy generally conforming to the contour of the bow of the vessel, but positioned for storage behind the rub rail perimeter. The canopy for the personal watercraft can be manufactured from the group consisting of, but not limited to canvas duck, nylon, rayon and plastic cloth.

When stored, the folded convertible canopy also acts as a bow water spray deflector, deflecting a portion of the sea water from splashing upon the operator and passengers. When in the upright position, the airfoil character of the canopy provides hull lift which is proportional to the speed of the watercraft. The hull lift reduces the drag coefficient of the water, increases speed, and improves fuel economy. The upraised canopy support members further provide hand hold surfaces for passenger comfort and for their safety. When upright the canopy members can have affixed to them a rain guard windshield and curtains. These are not part of the present invention.

The canopy and the support rails may be readily removed when said watercraft is locked into a barge vessel, dry docked or garaged for storage

BACKGROUND ART

The use of folding canopies which utilize folding frame structures which are covered with a fabric cover on boats to shield the occupants from the effects of the sun, rain or water spray are well known in the art. The canopy frames are suitably affixed to the boat surface and are secured thereto by a combination of cylindrical members, fittings and straps.

Examples of the prior art can be found in U.S. Pat. No. 2,817,345 granted to R. S. Woodruff Sr. on Dec. 24, 1957 entitled "Boat Canopy Support"; U.S. Pat. No. 2,823,684 granted to O. F. Sartori Feb. 18, 1958, entitled "canopy For Boats"; U.S. Pat. No. 4,582,016 granted to Hansen on Apr. 16, 1986 entitled "Collapsible Frame Structure For Boat Roof"; U.S. Pat. No. 4,683,900 granted to Carmichael, Apr. 4, 1987 entitled "Boat Canopy.

Many types of canopies are available in the prior art for providing protection for the boat operator from the effects of the sun or inclement weather. The shelter afforded by these canopies is particularly important when the operator is using his boat for a prolonged period of time or when other shelters are not nearby.

A major problem with folding boat canopies of the prior art may be described as follows: When the canopy is folded or collapsed, there is no convenient manner or location in which the canopy can be stored. In some designs such as U.S. Pat. No. 5,016,558, granted to Oehler, on May 21, 1991, the collapsed roof canopy is allowed to lie on the normal boat rails which are located on the aft and starboard side of the boat.

In patent '558, the collapsed canopy and the support members occupy the major portion of the vessel and greatly restrict the space available for the boat operator and passengers.

U.S. Pat. No. 5.6,697,320 granted to Robert W. Murray in 1997 shows another personal watercraft folding canopy. Unlike the present invention, this patent describes a folding canopy which is stored at the stem of the watercraft. This invention is shown in FIG. 16. At the time of this application, the above referenced patent has not been printed for general use, but the notice of issue has been received by this office, and is application Ser. No. 08/618,633.

U.S. Pat. No. 5,361,717 granted to Kobayashi on Nov. 8, 1994 describes a folding canopy on a small watercraft, having a first poson which shields the passengers from the sun, and having a second position in which the canopy extends above the rear of the boat when collapsed and stored. U.S. Pat. No. 3,195,549 granted to M. T. Stevens on Jul. 20, 1965 illustrates a folding canopy arrangement wherein the canopies lay flat on the rear end of the boat hull. This arrangement often reduces the free space available on the vessel.

The prior art discloses many different types of collapsible canopies on boats. One of the major problems with these types of collapsing canopies, is that they interference with boat access and degrade vessel performance when the canopies are collapsed. This is especially true in small boats such as "Jet Ski" types of watercraft, more commonly referred to as a "Personal Watercraft". These high speed watercraft are found on lakes, oceans, and bodies of water where people play at boating. Because of the higher speed involved, the aforementioned defects become of major importance to the boat owner. The added air resistance of the canopy in both the upright and collapsed position contributes to air resistance and increases the drag of the boat when the boat is in operation. The increased drag coefficient reduces the speed of the vehicle and contributes to poor fuel economy.

SUMMARY OF THE INVENTION

It is an object of this invention to provide a collapsable canopy for a personal watercraft, wherein said canopy is supported by a plurality of support members which are collapsable as described herein. Said canopy being characterized by having a means of storage wherein the collapsed canopy is stored on the forward top of the hull, above or behind the rub rail, conforming to the general shape of the hull bow when collapsed. The canopy storage means provided by the present invention is both functional and attractive. When extended, the canopy bowed section and side members are secured to the hull upper surface of the watercraft by a connecting means described herein. The tubular or oval shaped support brackets for the canopy introduce a minimum of air resistance.

Another object of the invention provides that the collapsed canopy is also a means for deflecting water away from the operator or passengers of the personal watercraft, and thereby acts as a splash guard. Said canopy is further protected by a zippered sheath or canopy cover, which slides around and over the collapsed canopy and is zippered closed. A strap or bungee cord on the canopy cover secures the closed canopy to the vessel body.

It is a further object of the invention to provide a parabolic airfoil shaped canopy when extended whereby the upright canopy provides a controlled amount of hull lift when the watercraft is in motion. Said lift creates a reduced hull to water restriction, which is proportional to speed, thus allowing the vessel to move faster on the water.

It is another object of this invention to provide a collapsing canopy, movable from a first position to a second position, wherein the first position is with the canopy mounted upright, and wherein the second position is with the canopy in a prone or collapsed or storage position. Movement of the canopy from the first position to the second position is enabled by first removing the stabilizing straps, and then rotating the plurality of rigid support members, the base of which are secured to pivoting hinges which are firmly and permanently affixed to the vessel surface, from the upright position to the storage position, as described herein.

The rigid support members retain sufficient strength when extended, whereby the passengers within the personal watercraft may safely grasp the canopy frame for increased personal support and added safety.

Accordingly, this invention features a convertible canopy which comprises a forwardly collapsible frame. Said frame may be manufactured from aluminum or stainless steel, plastics such as Nylon or Celcon, wherein anodized aluminum tubular stock is the preferred material. The frame further comprising a plurality of transverse support members, said support members described are generally slightly bowed to conform to the deck portion on which they lie when collapsed, with an upper section which is generally parabolic in shape, for supporting the canopy.

The support members are connected together and to the vessel surface with cast or machined solid metal jaw slide and eye end fittings which are designed to be locked in place by a manually adjustable set screw. The manually adjustable set screws are shown as circular in shape, they may however, be fluted or irregularly shaped for improved grasping under wet conditions.

Adjustable eye straps and fittings provide canopy support and also a means for providing frame member tension while the canopy is in the upright position. The straps are unhooked from their fixed fittings on the hull end prior to folding the canopy, and the straps are stored within the covering of the stored canopy. The front straps are adjustable, but once adjusted, remain fixed in length. The rear straps include a quick release feature. This is important because the rider of the watercraft may want to quickly drop and store the canopy. The fittings may be cast or machined from the group of metals consisting of aluminum, and stainless steel, with anodized aluminum as the preferred material.

The foregoing and other features of the present invention will become more apparent from the following description and accompanying drawings.

DESCRIPTION OF THE DRAWINGS

FIG. 1 is a perspective frontal view of the personal watercraft of the instant invention, illustrating the canopy in the first or upright position.

FIG. 2 is an orthogonal projection of the personal watercraft, showing the canopy in the second or collapsed position. In this view, the canopy zippered cover is installed, and the canopy is secured by a suitable means to the watercraft body.

FIG. 3 illustrates the major watercraft component parts comprising the canopy and support members which are attached to the personal watercraft.

DESCRIPTION DESCRIPTION OF THE REFEREED EMBODIMENT

Figure 4:
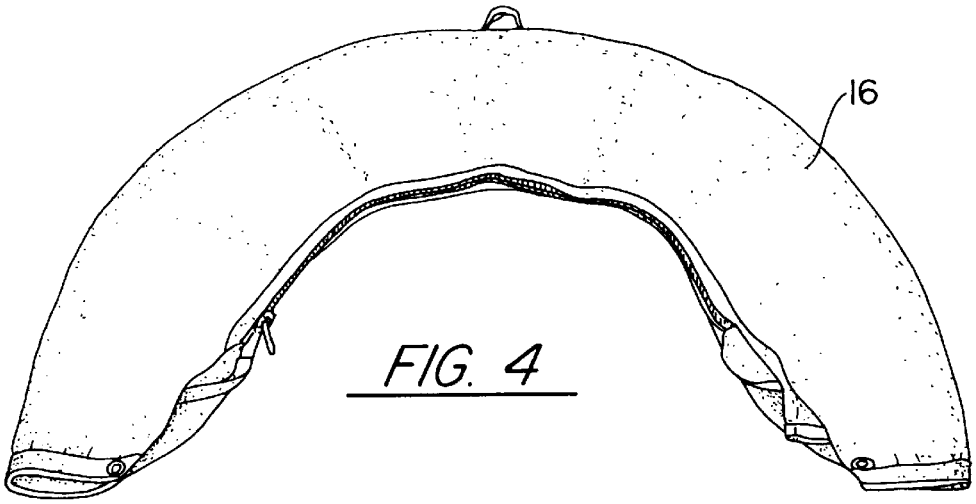
FIG. 4 is a top view of the zippered canvas sheath cover which encloses the canvas canopy top while in the closed or collapsed position.

Referring now to more specifically to the drawings, FIG. 1 illustrates the personal watercraft of the present invention with the canopy 4 in the upraised or extended position. The entire surface of the forward hull 20 top is available for storage of the collapsed canopy.

It is known that personal watercraft of the type depicted in the present invention have many similar shapes of bow utilized in their designs. By allowing the collapsed canopy to be stored on the top portion of the foreword hull, many watercraft configurations may be accommodated for a streamlined, attractive appearance.

FIG. 2 shows the canopy in a collapsed position with a zippered cover 16 in position. A strap means 19 secures the closed canopy to the hull. The strap means may be an adjustable strap or a bungee cord, with the adjustable strap means as the preferred embodiment.

The canopy is assembled with a fabric or plastic material which is stretched over and secured to a plurality of generally parabolically shaped curved sectors which comprise the uppermost and central portion of the support members 1,2 and 3. These support members generally have slightly bowed arms and a curved upper section, the entire support being designed be generally parabolic in shape, conforming to the general shape of the vessel bow. The uppermost central sectors of each support member are hereinafter simply referred to as a "curved sector", and the side support members, though slightly curved, are simply referred to herein as a "support member", for the sake of brevity.

The support member 3 in FIG. 3 is the longest or major member and occupies the rear position of the canopy. Support member 1 is mid-sized and occupies the forward position of the canopy assembly. Support member 2 is the shortest member and occupies the central position of the canopy assembly. All support members are used to support the canopy 4 illustrated in FIG. 3. The extended canopy is appropriately shaped to provide an airfoil effect when the canopy is extended and the vessel is in motion.

Each support member has a top curved central section and a middle extended section which terminates in a first and second mounting end. The top curved central section conforms to the shape of the frontal bow area of the vessel. The extended section arcs from the curved central section to the first and second mounting ends, whereby the extended section may be curved to conform to the general shape of the bow of the vessel. The first and second ends of the support members 1 and 2 in FIG. 3 are assembled with an Eye End fitting 11 is secured to the tubular support member ends using a set screw 54 FIG. 6 which is screwed into the tubing support member.

Two Jaw Slide hinges 12 are slidably mounted over the first end of major support member 3 and two Jaw Slide hinges 12 are slidably mounted over the second end of the tubular support member 3 to provide slidably positioning height connections for support members 1 and 2 which control the airfoil effect of the canopy.

Figure 5:
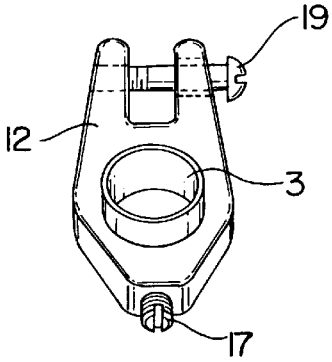
FIG. 5 is a three dimensional view of a "jaw Slide" fitting with hinge pin and set screw for mounting on the number three the pole frame member, the jaw slide further having a manually adjustable set screw thereon to secure the jaw slide to the pole member.
Figure 6:
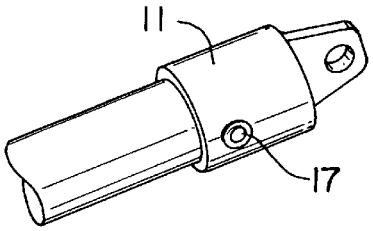
FIG. 6 is a three dimensional view of the "Eye End Slip Fit Joiner" which is integrally mounted into the jaw slide, having an open end which can join to a first and second end of a pole member, wherein the jaw slide and the eye end slip fit member and hinge pin elements form a pivotally moveable joint, allowing for an oscillating position of the pole members from a first upright position to a second collapsed position.

Eye Ends 11 illustrated in FIG. 3 on support members 1 and 2 are joined to the Jaw Slide hinges 12, also illustrated in FIG. 3, which are mounted on support member 3, by inserting hinge pin 18 FIG. 5 through right arm bore of Jaw Slide hinge 12 FIG. 5, through bore of Eye End 11 FIG. 6 and into the left arm threaded bore of the Jaw Slide hinge. This allows pivotable movement of the connecting support members 1 and 2.

Figure 7:
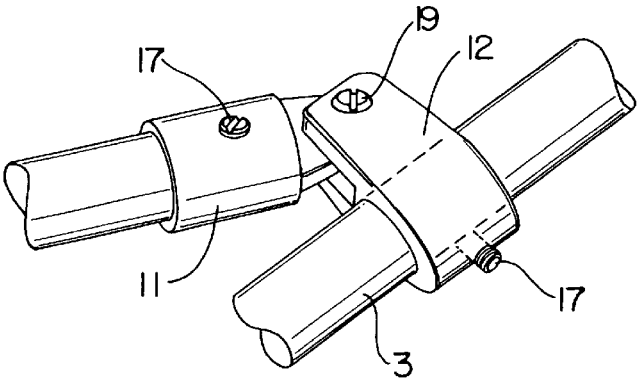
FIG. 7 illustrates the combination of the jaw slide member and the eye end slip fit member, secured by the hinge pin. The manually locking set screws can be seen in this view.

Jaw Slide hinges are able to slide into position with support members 1 and 2 with Eye Ends. These are secured in place on support member 3 FIG. 3, using the manually adjustable set screws 17 which are screwed into support member 3 FIG. 7.

Figure 8:
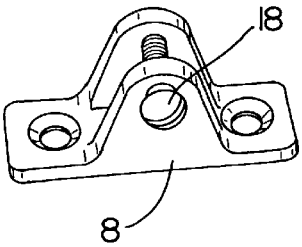
FIG. 8 portrays the deck mounting hinge which is secured to the vessel surface, and which provides a 180 degree pivotal positionable joint for erection of the canopy members.

Two Eye Ends 11 FIG. 6 are installed on the first and second ends of the major support member 3 and joined to Deck Hinges 8 FIG. 8, by inserting hinge pin 18 through the right arm bore of the deck hinge 8, through the bore of the eye end 11 and into the left arm threaded bore of the deck hinge. A deck hinge is mounted on the top side of the rub rail molding on the port and starboard side and centered approximately to the beam of the vessel. This connection means allows major support member 3 with the connected support members 1 and 2 to pivot into a collapsed prone position upon the bow of the vessel from the upright, deployed position.

The curved central sector of each support member is held in their respective forward center and rear positions by canvas cloth 4 which is sewn around the tubular support members while in the upright deployed position with support members 1 and 2 connected to support member FIG. 3.

The canopy apparatus is mounted above the seating area of the personal watercraft using deck hinges 8 and is supported in the upright position by four adjustable straps 5 and 6. Note that the fastening fixtures on the reverse side of FIG. 3 are not shown, but are understood to exist there. There are four strap assemblies. Two fixed frontal straps 6, and two rear strap assemblies 5. Each strap assembly is comprised of a strap, a sewn eye loop in said strap, a buckle 10 for strap adjustment, a ring eye snap hook 13, and an eye strap 9 FIG. 15. The rear straps differ from the front straps in that they include a quick release tab, which releases the strap tension to the canopy with a simple pull by the operator.

Figure 11:
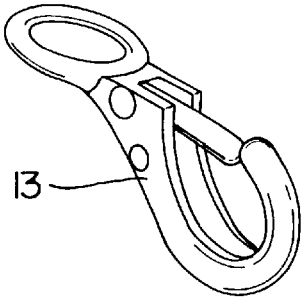
FIG. 11 is a view of the latching hook that is used to secure the vessel end of the tensioning strap to the vessel body.
Figure 12:
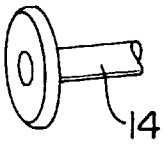
FIG. 12 is a view of a rivet that is installed through the second end of each forward tensioning strap and therethrough the upper canopy canvas on the forward comer of each side of the cover and thence into a drilled section of the No 1 pole member which has been adapted to receive said rivet and has a means to secure the rivet in place.
Figure 13:
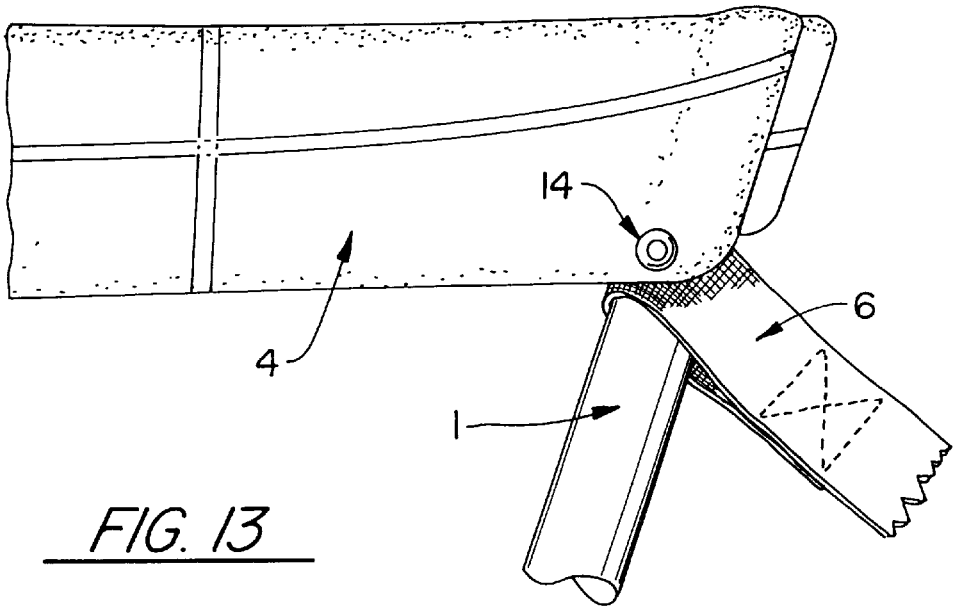
FIG. 13 illustrates the rivet installed through the canopy canvas, for securing the tensioning strap into the No. 1 pole member aperture.
Figure 14:
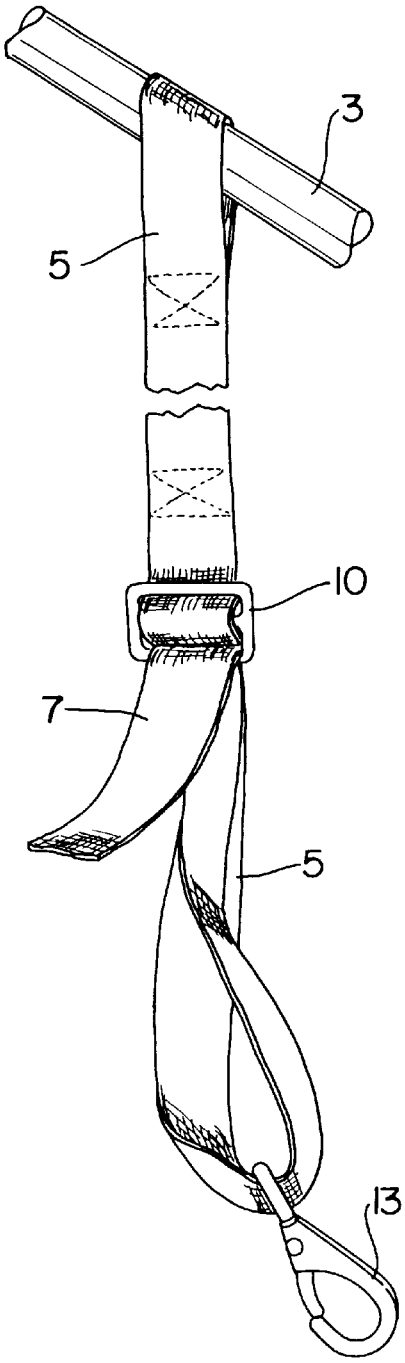
FIG. 14 is a detail of one of the rear tensioning straps. The upper section of the strap is stitched into a loop for mounting on support member. The buckle adjusts the length and the strap tension. This strap has a pull tab, which when pulled causes the strap to release its tension and lengthen the strap.
Figure 15:
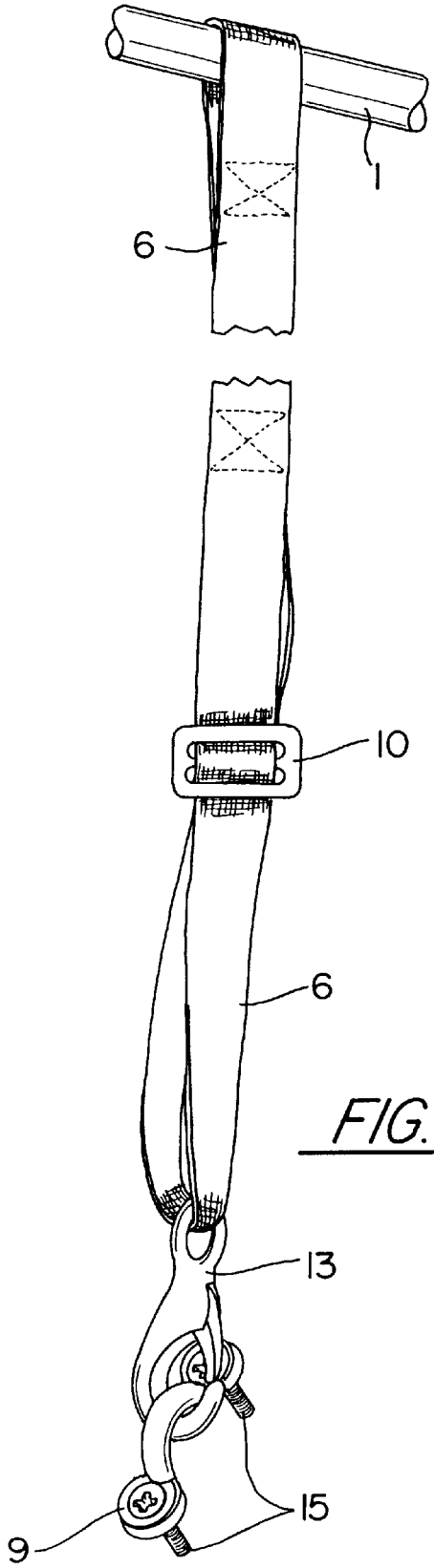
FIG. 15 shows the detail of one of the two front strap assemblies. This strap is also connected between the support member and an eye strap fitting on the vessel surface. This strap length is adjustable, but does not have the same quick release feature as the rear straps.

The adjustable straps have a first end and a second end. The first end of straps 6 FIG. 3 having a one inch loop sewn therein, whereupon said loops are slidably positioned around the port and starboard sides of support member 1 to a fixed position under the frontal comer edges of the canopy. At this position, a rivet 14, is installed through the canvas cloth 4 FIG. 13, through a portion of the strap loop 6 and into support member 1. The second of the straps have a spring loaded hook 13 FIG. 11 which incorporates a ring eye, visible in FIG. 15, such that the strap is looped through the eye ring and back upwards into an adjuster buckle 10, The completed strap assemblies are shown in FIGS. 14 and 15. FIG. 14 is the rear strap assembly and FIG. 15 depicts the frontal strap assembly.

There are four adjuster buckles 10, shown in FIG. 3, one on each of the four supporting straps. The adjuster buckles allow for tensioning the straps to spread all the canopy support members.

Figure 9:
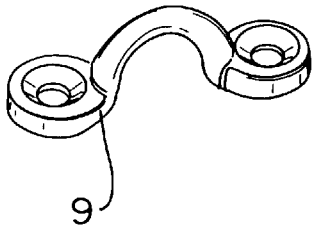
FIG. 9 is a three dimensional view of an "Eye Strap" which is bolted to the vessel surface and is used with the hook and tensioning straps for canopy support.
Figure 10:
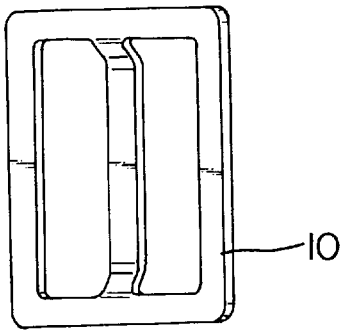
FIG. 10 is a view of the adjuster buckle which is used to adjust the strap length between the supporting hook and the pole to which the strap is affixed, wherein the pole tension can be applied to the canvas canopy when it is in the upright position.

The spring loaded hook 13, is attached to the looped second ends on each of the four straps and is also clipped around an Eye Strap 9 FIG. 9, which uses bolt fasteners 15, inserted through bores to secure the Eye Straps to the vessel surface. This is illustrated in FIG. 15.

Two eye straps are secured to the front top cowling portion on the port and starboard side of the vessel 9. One Eye Strap 9 is also secured to each port and starboard top, rear portions of the rub rails. Note that the illustration in FIG. 3 only shows the starboard side for the sake of brevity. The port side mountings are identical.

On straps 5 the first end of the straps having a one inch loop sewn therein are slidably mounted upon support member 3 to a non fixed slidable position above the Jaw Slide Hinge assemblies 11 and 12. Straps 5 are allowed to oscillate positions between Jaw Slide Hinges and rear side edges of canopy 4 on support member 3 to accommodate folding all straps neatly within a canvas sheath covering 16 FIG. 4. This covering is applied when the canopy is in the collapsed prone position, illustrated in FIG. 2. The second ends of straps 5 are identical in construction to the second end straps of 6 with the exception that their mounting locations are on top, rear, port and starboard side of the vessels rub rail molding with the further exception that straps 5 have a tension release strap 7, FIG. 14 which is sewn around a portion of adjuster buckle 10.

Although this invention has been shown and described with respect to detailed embodiments thereof, it will be appreciated and understood by those skilled in the art that various changes in form and detail thereof may be made without departing from the spirit and scope of the claimed invention.

I claim:

1. A canopy having pivotal support members in combination with a personal watercraft having a hull and rub rail, said canopy having an upright position and a collapsed position, said upright position being movable to said collapsed position to lie prone on the forward upper section of said hull, wherein said canopy is positioned therein within the limits of said rub rail contained on the periphery of said watercraft, the canopy further fitting on the upper surface of said rub rail in a manner which provides storage when the canopy use is not desired, said canopy when in said collapsed and prone position defining a protective splash guard, and said canopy and said support members providing an independent hand-held for added safety, balance, and stabilization of the passengers when said canopy is extended in the upright position.

2. A canopy for the personal watercraft of claim 1 wherein the canopy, when folded conforms to the general shape of the bow of the watercraft.

3. A canopy for the personal watercraft of claim 2 wherein the canopy conforming to the general shape of the watercraft, wherein the general shape is parabolic.

4. A canopy for the personal watercraft of claim 1 wherein the canopy, support members have a central section which are pre-formed to conform to the general bow shape.

5. A canopy for the personal watercraft of claim 1 wherein the canopy is selected from the group consisting of, canvas duck, nylon, rayon, and plastic cloth.

6. A canopy for the personal watercraft of claim 1 wherein said canopy support members are tubular and provide safety hand-holds for independent passenger balancing and stability.

7. A canopy for the personal watercraft of claim 1 including front and rear support straps interconnecting said canopy and said watercraft, a quick release mechanism, said rear support straps and said quick release mechanism being operatively connected to each other for rapidly collapsing the canopy.

8. A canopy having pivotal support members in combination with a personal watercraft having a hull and rub rail, said canopy having an upright position and a collapsed position, said upright position being movable to said collapsed position to lie prone on the forward upper section of said hull, wherein said canopy is positioned thereon within the limits of said rub rail contained on the periphery of said watercraft, the canopy further fitting on the rub rail of said water craft in a manner which provides storage when the canopy use is not desired, said canopy when in said collapsed and prone position defining a protective splash guard, and said canopy having a parabolic shape when in said upright position, providing lift when the watercraft is in motion wherein the lift reduces the amount of water resistance.

* * * * *